US010526174B2

(12) United States Patent
Griffin, Jr. et al.

(10) Patent No.: US 10,526,174 B2
(45) Date of Patent: Jan. 7, 2020

(54) SYSTEM AND METHOD FOR A SELF-CONTAINED LIFTING DEVICE

(71) Applicant: Core Laboratories LP, Houston, TX (US)

(72) Inventors: Ted J. Griffin, Jr., Spring, TX (US); Jason M. Ashby, Cypress, TX (US); Jeremy M. Bland, Magnolia, TX (US); Derek R. Beckett, Tomball, TX (US)

(73) Assignee: Core Laboratories LP, Houston, TX (US)

( * ) Notice: Subject to any disclaimer, the term of this patent is extended or adjusted under 35 U.S.C. 154(b) by 73 days.

(21) Appl. No.: 15/276,584

(22) Filed: Sep. 26, 2016

(65) Prior Publication Data

US 2017/0008738 A1 Jan. 12, 2017

Related U.S. Application Data

(63) Continuation of application No. 14/477,676, filed on Sep. 4, 2014, now Pat. No. 9,682,848.

(60) Provisional application No. 61/906,343, filed on Nov. 19, 2013.

(51) Int. Cl.

| | |
|---|---|
| ***B66C 1/42*** | (2006.01) |
| ***E21B 25/00*** | (2006.01) |
| ***B66C 23/14*** | (2006.01) |
| ***B66C 23/20*** | (2006.01) |

(52) U.S. Cl.

CPC ..... *B66C 1/42* (2013.01); *B66C 23/14* (2013.01); *B66C 23/206* (2013.01); *E21B 25/005* (2013.01)

(58) Field of Classification Search

CPC ..... B66F 9/00; B66C 23/14; B66C 23/206; E21B 49/02; E21B 25/005

USPC ..... 175/249

See application file for complete search history.

(56) References Cited

U.S. PATENT DOCUMENTS

| | | | | |
|---|---|---|---|---|
| 4,098,082 | A * | 7/1978 | Packer | B66C 13/02 254/900 |
| 5,109,697 | A * | 5/1992 | Millheim | E21B 49/02 175/50 |
| 6,679,333 | B2 * | 1/2004 | York | E21B 19/084 166/379 |
| 2004/0134105 | A1 * | 7/2004 | Loeb | E02F 3/384 37/348 |
| 2009/0248258 | A1 * | 10/2009 | Fukumoto | A01B 79/005 701/50 |
| 2010/0324868 | A1 * | 12/2010 | Russell | B23K 10/00 703/1 |
| 2011/0100718 | A1 * | 5/2011 | Drenth | E21B 25/12 175/246 |

FOREIGN PATENT DOCUMENTS

WO WO 2010/046757 * 4/2010

* cited by examiner

*Primary Examiner* — Ronald P Jarrett
(74) *Attorney, Agent, or Firm* — Fletcher Yoder P.C.

(57) ABSTRACT

A modular lifting system, including an enclosable lifting device support structure. The enclosable lifting device support structure includes a deployable top, a plurality of lateral sides, a base coupled to the plurality of lateral sides, and a plurality of extension arms. The deployable top is configured to support a lifting device on a first side of the deployable top. The plurality of extension arms are configured to extend and support the deployable top when the deployable top is deployed.

17 Claims, 7 Drawing Sheets

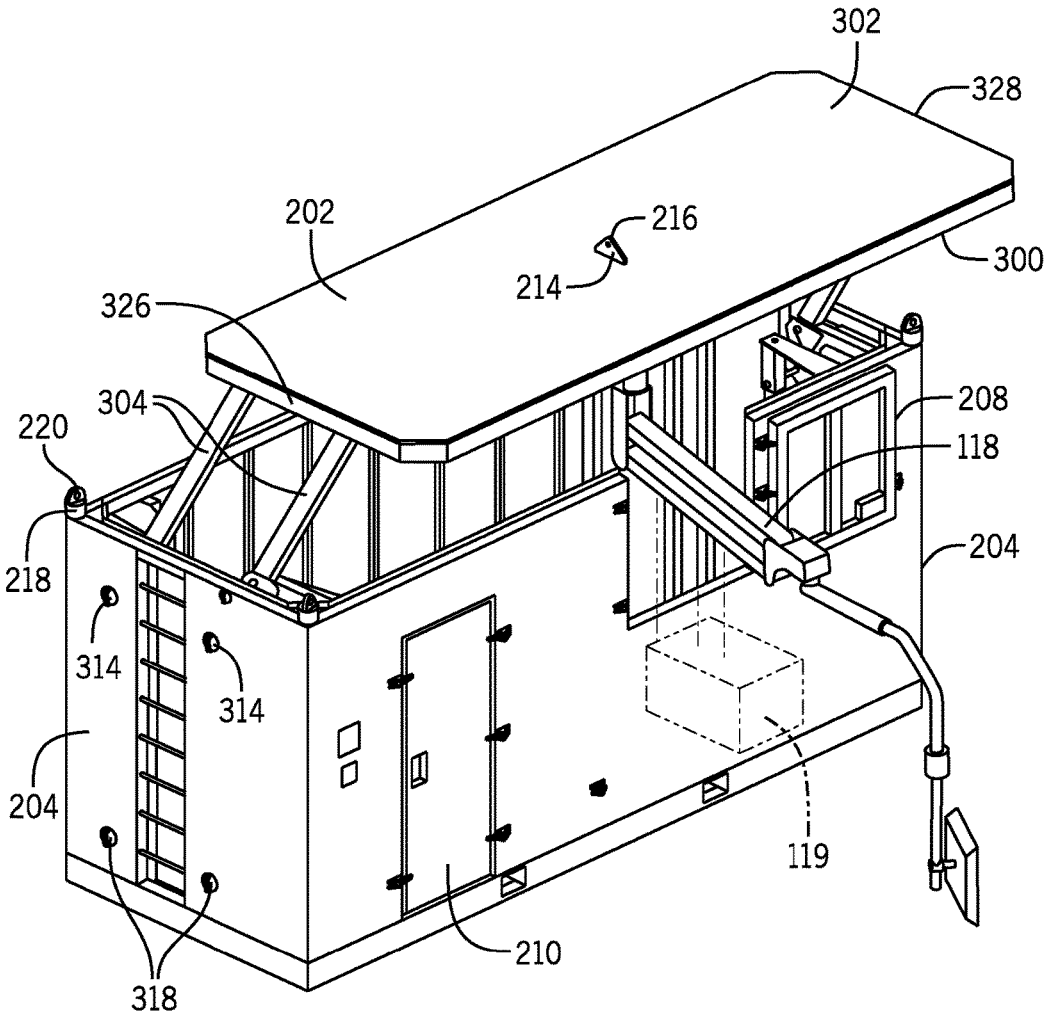
FIG. 3
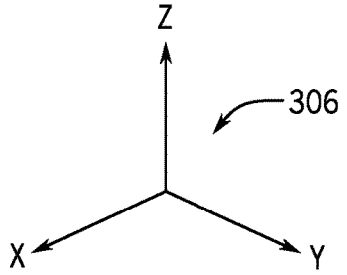

SYSTEM AND METHOD FOR A SELF-CONTAINED LIFTING DEVICE

CROSS REFERENCE TO RELATED APPLICATIONS

This application is a continuation of U.S. patent application Ser. No. 14/477,676, entitled "SYSTEM AND METHOD FOR A SELF-CONTAINED LIFTING DEVICE," filed Sep. 4, 2014, which claims priority from and the benefit of U.S. Provisional Application No. 61/906,343, entitled "SYSTEM AND METHOD FOR A SELF-CONTAINED LIFTING DEVICE," filed Nov. 19, 2013, both of which are herein incorporated by reference in their entirety for all purposes.

BACKGROUND

The present disclosure relates generally to lifting devices. More specifically, the present disclosure relates to a self-contained lifting device that may be used for lifting heavy objects in a workspace, such as on an oil and gas drilling rig.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The oil and gas industry frequently performs offshore drilling operations. Offshore drilling is a process where a borehole, a small diameter hole in the ground, is drilled through the seabed or the Earth's surface in order to explore and extract petroleum that lies beneath the seabed or surface. The offshore drilling process generally takes place from an offshore oil platform. An offshore oil platform, or oil rig, is a large structure with facilities to drill wells, to extract and process oil and natural gas, and to temporarily store product until it can be brought to shore for refining. During the offshore drilling process, subsurface samples, or samples from beneath the seabed, may be retrieved and analyzed to determine characteristics, such as porosity (i.e., the capacity of the rock to hold fluids) or permeability (i.e., the ease by which a fluid can flow through the reservoir rock), of the surrounding area.

The subsurface samples are often retrieved in a long (e.g., 120-240 feet) cylinder known as a core. The core is then cut or sawed into core sections (e.g., 3 feet long). Once a core section is obtained, the ends of the core section are capped, and the core is placed in a safe for transport.

Current methods for handling core sections have created several challenges in the industry. The core sections can weigh anywhere between 40 and 120 pounds and can be up to six inches in diameter. Currently, individuals lift core sections and physically move the core based on training describing proper lifting technique. Moving heavy cores by hand may be cumbersome and labor intensive. Shorter tubes may be considered to decrease the weight of the tubes, however, such tubes may be undesirable from a geological analysis standpoint. Accordingly, a process and system for handling core sections is needed.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In a first embodiment, a modular lifting system includes an enclosable lifting device support structure, including a deployable top configured to support a lifting device on a first side of the deployable top, a plurality of lateral sides, a base coupled to the plurality of lateral sides, and a plurality of extension arms configured to extend and support the deployable top when the deployable top is deployed.

In another embodiment, a method includes positioning a self-contained, modular lifting system, including a lifting device, adjacent to a workspace, deploying a deployable top of the self-contained, modular lifting system, wherein the lifting device is supported by the deployable top, positioning the lifting device over the workspace, and lifting an object with the lifting device.

In a further embodiment, a self-contained lifting system includes a lifting device support structure, including a base, a plurality of lateral sides extending from the base, a deployable top disposed above the plurality of lateral sides, and a plurality of extension arms configured to raise and lower the deployable top, wherein the base, the plurality of lateral sides, and the deployable top define a self-contained volume, and a lifting device disposed within the self-contained volume and supported by the deployable top.

In another embodiment, a system includes a contained lifting device support structure and a lifting device. The contained lifting device support structure includes a plurality of lateral sides and a base coupled to the plurality of lateral sides. The lifting device is disposed within an interior volume of the contained lifting device support structure, wherein the lifting device is configured to enable overhead lifting of objects adjacent to the system.

DRAWINGS

These and other features, aspects, and advantages of the present disclosure will become better understood when the following detailed description is read with reference to the accompanying drawings in which like characters represent like parts throughout the drawings, wherein:

FIG. 3 is a perspective view of a self-contained lifting system with a deployed top, in accordance with an embodiment of the present disclosure;

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with systems-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more elements. The terms "comprising," "including," and "having" are intended to be inclusive and mean that there may be additional elements other than the listed elements.

Embodiments of the present disclosure are directed toward a self-contained lifting system with a lifting device. One use for such a lifting device may include lifting core sections on an offshore oil rig. The lifting system described below can be moved with a device suitable for heavy lifting. For instance, many offshore oil rigs have access to a crane or forklift for other uses. A self-contained lifting system can be lifted into the desired position with a crane. Once the self-contained lifting system is lifted into position, the lifting device may be deployed. More specifically, a deployable roof of the self-contained lifting system may be raised along with a lifting system supported by the deployable roof. With the deployable roof raised, the lifting system extends into the surrounding area to manipulate objects in the nearby vicinity. After a lifting operation or process is completed, the lifting system and the deployable roof may be retracted to re-enclose the self-contained lifting system. Thereafter, the self-contained lifting system may be removed from the workspace and/or positioned elsewhere for use in other lifting operations.

Figure 1:
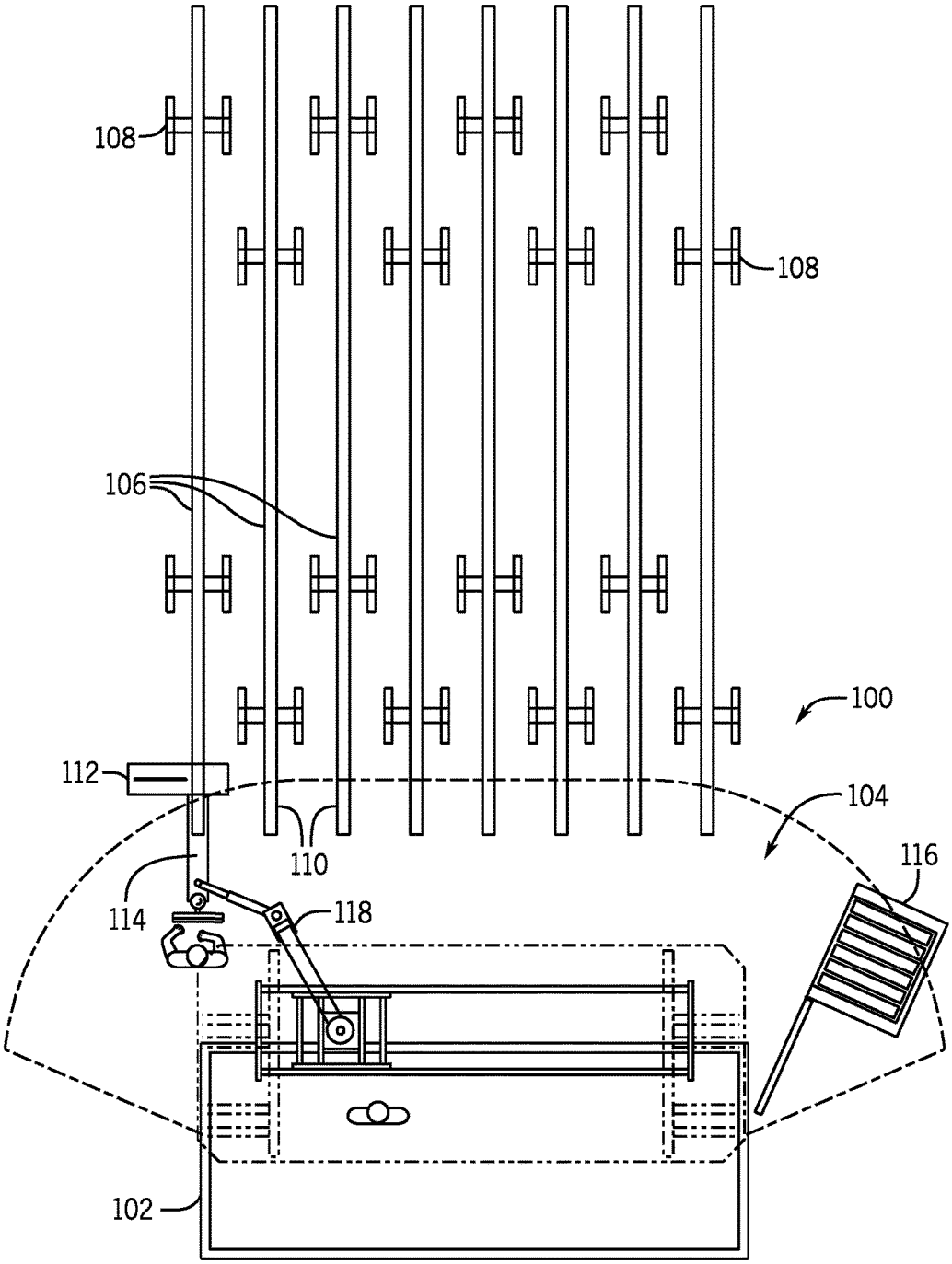
FIG. 1 is a top view of a self-contained lifting system and its workspace on an offshore oil platform, in accordance with an embodiment of the present disclosure.

Referring now to FIG. 1, a top view of an offshore oil platform 100 with a self-contained lifting system 102 is shown. The self-contained lifting system 102 is shown adjacent to a workspace 104. The workspace 104 is the area in which the self-contained lifting system 102 is used to lift objects. It may be a workspace 104 similar to that of the offshore oil platform 100, but it could also be anywhere where use of a lifting system 102 is desirable. The offshore oil platform 100 includes eight cores 106 held in place by core stands 108. A typical workspace 104 may include, for instance, portions 110 of the cores 106. While eight cores 106 are shown, the offshore oil platform 100 could have any number of cores 106, and any means of holding the cores 106 in place similar to the stands 108 could be used. Each of the cores 106 is cut with a saw 112 into core sections 114 (e.g., 1-5 feet) viable for testing. After being cut, the core sections 114 are moved into a core safe 116 to be transported for testing. In order to move the core sections 114 to the safe 116, a lifting device 118 (e.g., manipulator) of the self-contained lifting system 102 may move between the cores 106 and the safe 116 along tracks of the self-contained lifting system 102. While this provides a general example of how the self-contained lifting system 102 could be deployed, one of the advantages of the present embodiment is that it can be deployed in a variety of locations, and yet it is self-contained. Thus, the present disclosure should not be read to limit the self-contained lifting system 102 to applications on oil rigs or handling core sections 114. Indeed, the presently described self-contained lifting system 102 may be suitable for use any place where lifting objects is desirable.

Figure 2:
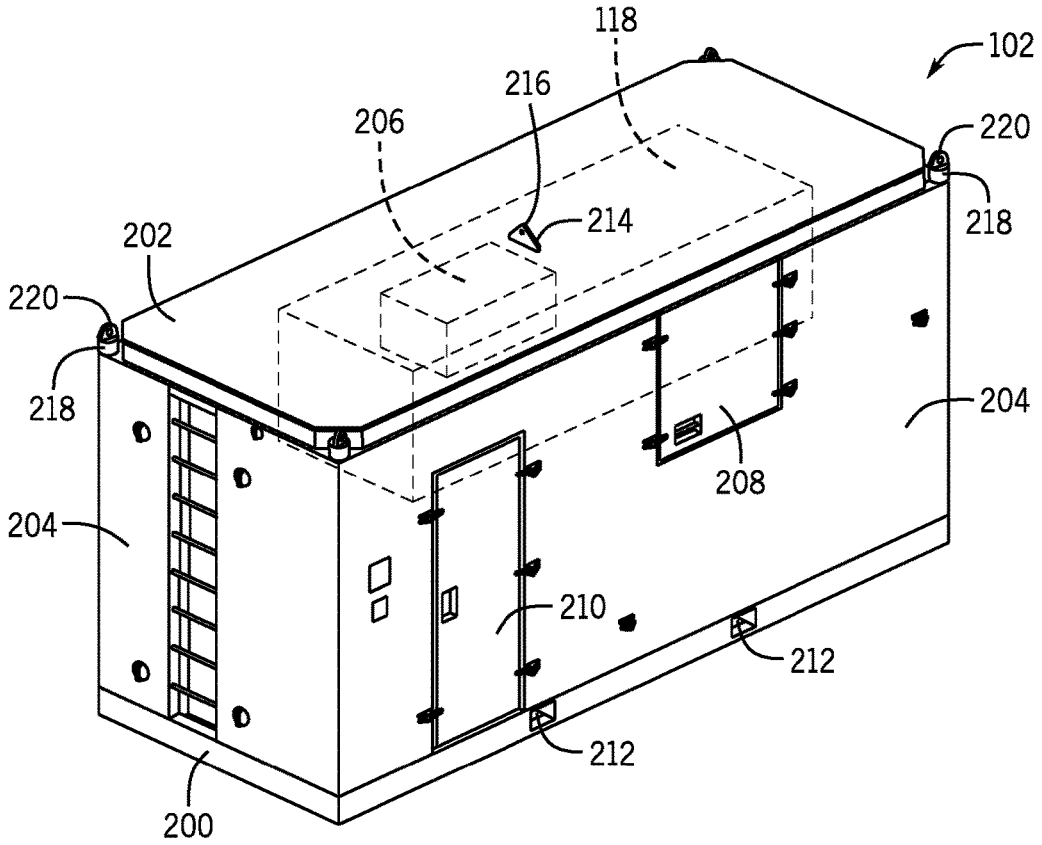
FIG. 2 is a perspective view of a closed self-contained lifting system, in accordance with an embodiment of the present disclosure.

To deploy the self-contained lifting system 102 for lifting objects (e.g., core sections 114), the self-contained lifting system 102 is first positioned adjacent to the workspace 104. As shown in the perspective view of FIG. 2, the self-contained lifting system 102 may be moved as a container. The system 102 may include a base 200, a deployable top 202, and lateral sides 204. The system 102 may be, for example, between 8-12 feet tall, 15-25 feet long, and 5-10 feet wide. The deployable top 202 of the self-contained lifting system 102 can be lifted from a first position (e.g., a closed position), as shown in FIG. 2, to second position (e.g., an extended or raised position), and then pivoted into a third position (e.g., a pivoted position). On a first side of the deployable top 202 (e.g., an underside), the system 102 may include a lifting device 118. In other words, the lifting device 118 may be coupled to and supported by the underside of the deployable top 202. By including a lifting device 118 on the underside of the deployable top 202, the system 102 may support overhead lifting (e.g., non-obtrusive lifting because the location and operation of the lifting device 118 is substantially overhead) of objects. The self-contained lifting system 102 may act as an enclosable and/or contained support structure of the lifting device 118. The lifting device 118, as described below, may be a third party lifting device 118 or may be included in the system 102.

Inside the self-contained lifting system 102, there may be a power connection 206. The power connection 206 may be a hydraulic, pneumatic, electromechanical, or other type of connection. The power connection 206 could be located on one of the lateral sides 204 of the system 102 (e.g., the side opposite the direction the deployable top 202 pivots in or opposite the side the door/access panel is located), near the lifting device 118, or anywhere that would be convenient to connect the power connection 206 of the system 102 to a power source. When the self-contained lifting system 102 is configured for transporting (e.g., shipped), as shown in FIG. 2, the power connection 206 can be disconnected such that the system 102 and/or the lifting device 118 is isolated from receiving or transmitting any power. When power is desired and no external source can be provided, a power source may be located inside the self-contained lifting system 102.

The system 102 may also include an access window 208. The access window 208 may be used to enable rotation of the lifting device 118 from an interior volume of the enclosable self-contained lifting system 102 to a surrounding environment of the enclosable lifting device 118 support structure after the deployable top 202 is deployed. In the illustrated embodiment, the lifting device 118 is positioned within the interior volume and is attached to a first side (e.g., the underside) of the deployable top 202. Additionally, the access window 208 is closed, thereby keeping the interior volume of the self-contained lifting system 102 closed and blocking the lifting device 118 from exiting the system 102. The system 102 may also include a door 210 for an operator. When the system 102 is being moved or transported, the operator may close the door 210 so that any interior objects (e.g., the lifting device 118) are contained inside. The closed door 210 and access window 208 may also block objects from the surrounding environment from entering the interior volume of the self-contained lifting system 102.

As shown in FIG. 2, the deployable top 202 is closed, such that the self-contained lifting system 102 is prepared for transportation adjacent to a new workspace 104. The system 102 may be lifted with heavy lifting machinery such as a forklift or a crane. To this end, the base 200 of the self-contained lifting system 102 may include forklift apertures 212 for inserting forks of a fork lift. Additionally, as mentioned above, many offshore oil platforms 100 have access to a crane. The crane may, for instance, interlock with a crane attachment point 214 having a lifting aperture 216 disposed on the deployable top 202. The crane attachment point 214 may support the self-contained lifting system 102 when it is being lifted and moved to the new workspace 104, as described above.

Additional crane attachment points 218 having lifting apertures 220 may also be used to help move the self-contained lifting system 102 to the new workspace 104. While four additional crane attachment points 218 are shown in FIG. 2, any location of any number of additional crane attachment points 218 may be used on or off the deployable top 202. Once the self-contained lifting system 102 is taken to a new workspace 104, the deployable top 202 can be raised, and the lifting device 118 may be deployed for use in a lifting operation.

If a crane is used to position the system 102 adjacent to a workspace 104, it may also be convenient to deploy the system 102 with the crane using the crane attachment point 214. For example, FIG. 3 is a perspective view of the system 102 with the deployable top 202 moved to the third position or pivoted position (e.g., deployed position). The lifting device 118 is coupled to a first side (e.g., underside) 300 of the deployable top 202 and extends out into the surrounding environment (e.g., the workspace 104) when the deployable top 202 is in the third or pivoted position shown in FIG. 3. The crane attachment point 214 may be coupled to a second side 302 (e.g., top or external side) of the deployable top 202. Extension arms 304 are shown supporting the deployable top 202 in the deployed position. The crane may lift the deployable top 202 from the first position (e.g., a closed position) extending the extension arms 304 to a second position (e.g., a raised or extended position) in the Z direction of the coordinate system 306. Next, the crane may pivot or rotate the deployable top 202 in the Y direction of the coordinate system 306 to a third position (e.g., the pivoted position). As the deployable top 202 moves in the Y direction, it causes the extension arms 304 to pivot with respect to the system 102. Other embodiments may use, for example, hydraulic lifts to deploy the deployable top 202.

In other embodiments, the lifting device 118 may be located on a pedestal of the self-contained lifting system 102. For instance, the lifting device 118 may be floor-mounted on a shaft or mounted on the second side 302 of the deployable top 202. In certain embodiments, the lifting device 118 may be located or mounted on a lateral side.

Interlocking pins 314 may be inserted into the self-contained lifting system 102 through one or more locking apertures 318 formed in one or more of the lateral sides 204. The interlocking pins 314 secure the system 102 in the closed position, the raised position, or the pivoted position. For example, if the deployable top 202 is in the closed position, interlocking pins 314 may be inserted into locking apertures 318 at the bottom of the lateral sides 204 to secure the deployable top 202 in the closed position as it is moved to another location. Conversely, as shown in FIG. 3, if the deployable top 202 is in the pivoted position, the interlocking pins 314 may be inserted in locking apertures 318 at the top of the lateral sides 204. When the interlocking pins 314 are inserted into the locking apertures 318, the interlocking pins 314 may engage with apertures formed in one or more linkages of the extension arms 304 to hold the extension arms 304 in place. In this manner, movement of the extension arms 304 and the deployable top 202 may be restricted when the deployable top 202 is in the closed position, raised position, or pivoted position. While four locking apertures 318 are located on the lateral side 204 shown in FIG. 3, different numbers of locking apertures 318 and interlocking pins 314 may be used to secure the deployable top 202 in a variety of positions.

In the illustrated embodiment, the lifting device 118 is shown hanging from the first side 300 of the deployable top 202 (e.g., the underside). As the deployable top 202 moves in the Y direction, the lifting device 118 may pass from the interior of the system 102 through the access window 208 into the surrounding environment (e.g., the workspace 104). The deployable top 202 may also enable translation of the lifting device 118 along the X axis of the coordinate system 306 from a first end 326 to a second end 328 of the deployable top 202. For example, as described below with reference to FIG. 4, the lifting device 118 may be coupled to rails disposed on the first side 300 of the deployable top 202, and the lifting device 118 may travel along the rails between the first end 326 and the second end 328. While the present embodiment translates the lifting device 118 along the X axis, in other embodiments, the lifting device 118 may translate along the first side 300 of the deployable top 202 in both X and Y directions of the coordinate system 306.

Figure 4:
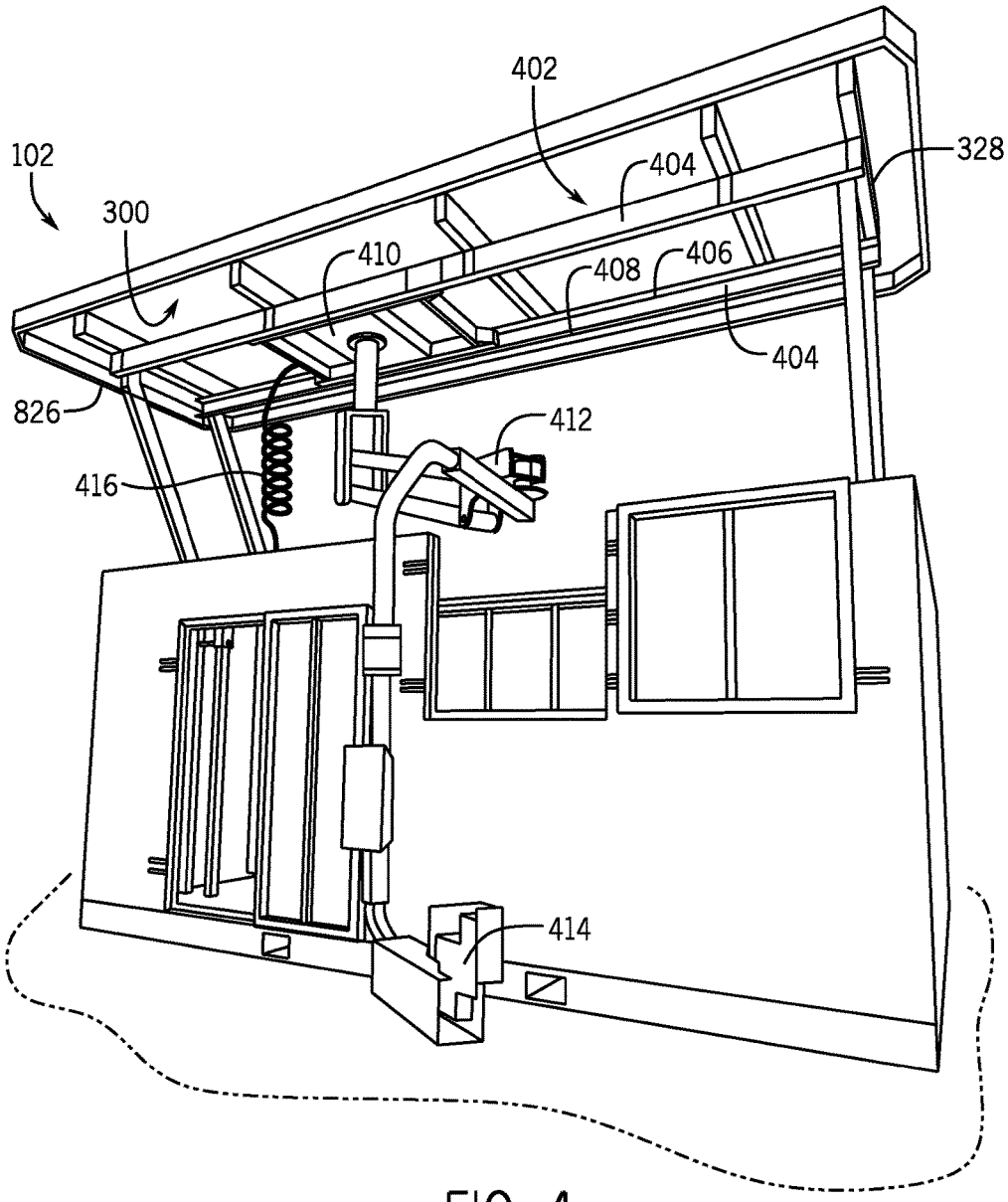
FIG. 4 is a perspective view of the self-contained lifting system with a deployed top including rails, in accordance with an embodiment of the present disclosure.

By providing a way to move the lifting device 118 along the deployable top 202, the system 102 can cover a wide span of the workspace 104, as opposed to a manipulator or other lifting device bolted to a fixed location. For example, FIG. 4 is a perspective view illustrating an example of, for instance, the system 102 capable of performing overhead lifting. Accordingly, the system 102 includes a track 402 coupled to the first side 300 for translating the lifting device 118 along the X axis of the coordinate system 306 from the first end 326 to the second end 328 of the deployable top 202. The track 402 may include rails 404 coupled to an upper ridge 406 and a lower ridge 408 with the ridges curled at an end. The upper ridge 406 and lower ridge 408 may support and guide rollers of the lifting device 118. The curled end and the rails 404 retain the lifting device 118 from deviating from the track 402.

In certain embodiments, the track 402 could be incorporated into a floor of the system 102. For example, the system 102 may include a shaft coupled to the track 402 on the floor of the system 102, and the lifting device 118 may be supported by the shaft. The track 402 may have similar features to those described the overhead lifting system 102 of FIG. 4. In other embodiments, the track 402 may be located on one or more lateral sides 204 of the system 102.

As shown in FIG. 4, the lifting device 118 includes a rail transport 410, an arm 412, and a plurality of grappling hands 414. The self-contained lifting system 102 may be configured to incorporate rail transport 410, the arm 412, the plurality of grappling hands 414, or any combination thereof separately (e.g., from a third party), or the system 102 may include the lifting device 118 in the self-contained lifting system 102. For instance, a third party manipulator including the arm 412 and the plurality of grappling hands 414 may be incorporated into the rail transport 410 of the self-contained lifting system 102. In other embodiments, a third party lifting device 118 including the rail transport 410, arm 412, and grappling hands 414 may be positioned along the track 402. The rail transport 410 may further include rollers retained in the track 402 to enable translation of the lifting device 118 along the track 402. When the lifting device 118 is used, it may receive power (pneumatic, hydraulic, or electrical) through tubing 416. The power received through the tubing 416 may be used to power the rail transport 410, the arm 412, and/or the grappling hands 414 of the lifting device 118.

The rail transport 410 may also include brakes to stop and restrict the lifting device 118 from undesired movement. When the lifting device 118 is not actuated, the brakes may lock with the rollers in position. The brakes may also help secure the lifting device 118 when the system is being transported to a new workspace 104. The rail transport 410, the arm 412, and the plurality of grappling hands 414 each provide different degrees of freedom in lifting objects, enabling the lifting device to move in the X, Y, and Z directions of the coordinate system 306.

Figure 5:
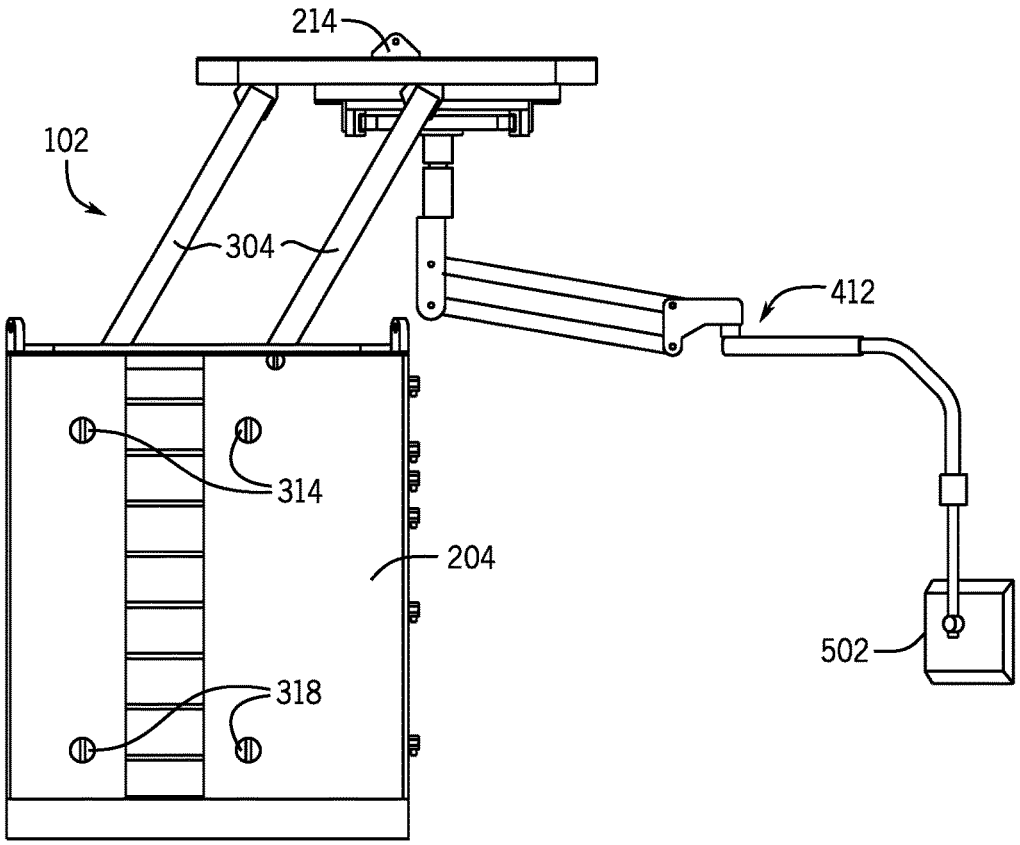
FIG. 5 is a side view of the self-contained lifting system in a deployed configuration, in accordance with an embodiment of the present disclosure.

The rail transport 410, the arm 412, and the plurality of grappling hands 414 of the lifting device 118 may be controlled by an operator to lift core sections 114, as described above. FIG. 5 is a side view of the system 102, illustrating a control panel 502 for the lifting device 118 of the self-contained lifting system 102 in a deployed position. The control panel 502 may be located at the end of the arm 412 of the lifting device 118. Alternatively, the control panel 502 may be located within the self-contained lifting system 102, connected via a wire to the system 102, or connected wirelessly.

The control panel 502 may enable the operator to set a lower movement limit, an upper movement limit, a left movement limit, a right movement limit, and/or other limits of movement of the lifting device 118. It may also be used to control any variety of components of the lifting device 118, such as the rail transport 410, the arm 412, the grappling hands 414, or any combination thereof. In some embodiments, the lifting device 118 may be controlled by an operator simply by guiding and moving the lifting device 118 into place. Similar to FIG. 3, the self-contained lifting system 102 may be deployed using the crane attachment point 214. When the deployable top 202 is deployed, the interlocking pins 314 may be inserted into one or more lateral sides 204 having high locking apertures 318. As shown in FIG. 5, the extension arms 304 are pivoted at approximately twenty to forty degrees from the second position (e.g., the vertically raised position). While the angle shown is around thirty degrees, any angle may be used that is convenient for deploying the lifting device 118. When lifting heavy objects, the weight of the self-contained lifting system 102 acts as a counter weight to keep the lifting device 118 from tilting. For example, the self-contained lifting system 102 may weigh approximately 10,000-30,000 pounds.

Figure 6:
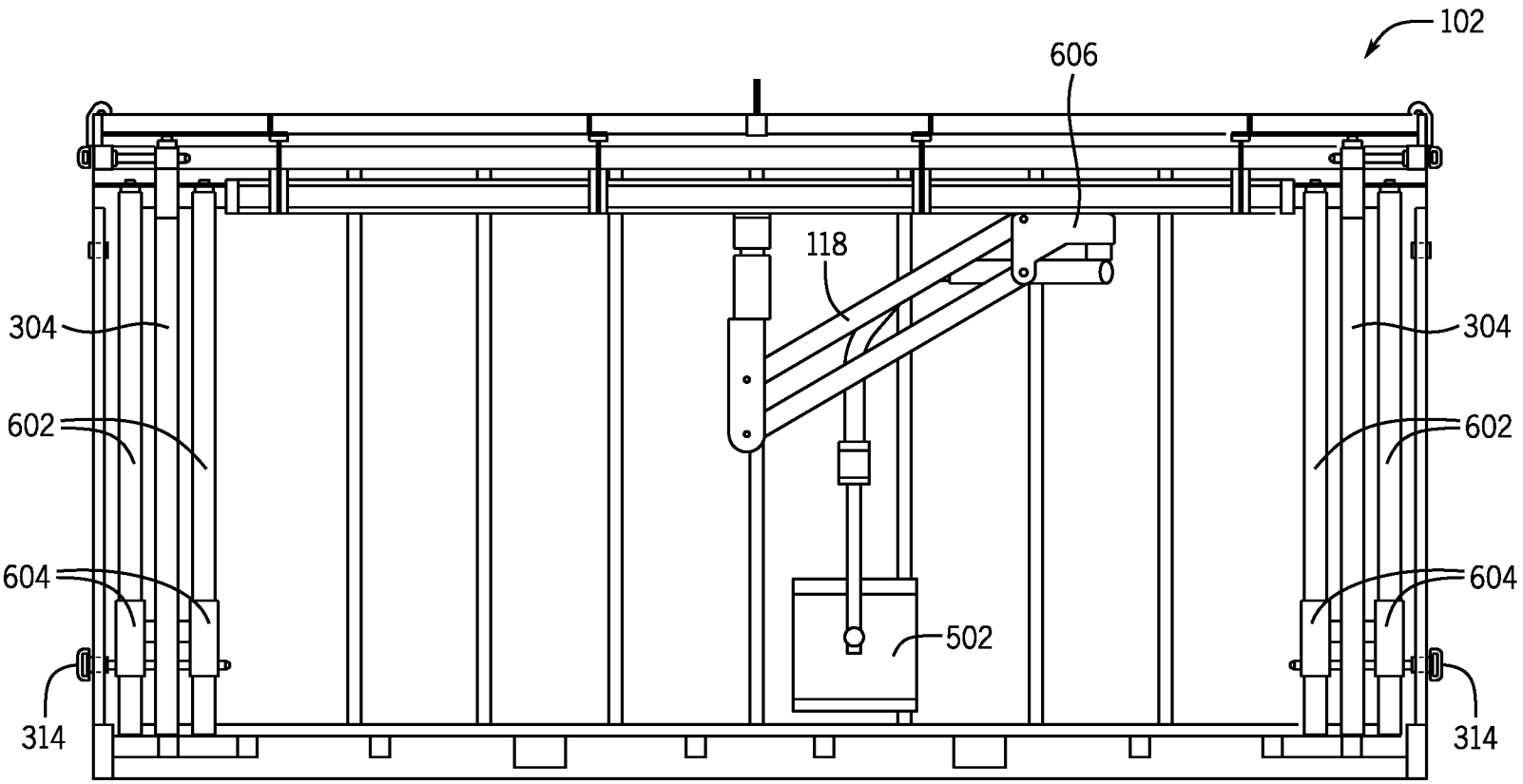
FIG. 6 is a cross-sectional side view of the self-contained lifting system, in accordance with an embodiment of the present disclosure.

In order for the pivoted extension arms 304 to support the deployable top 202, the lifting device 118, and other objects lifted, the system 102 may include supports for the extension arms 304. The supports may also help secure the device for shipping. For example, FIG. 6 is a cross-sectional side view of the self-contained lifting system 102 in a closed position ready for shipping to a new workspace 104. The system 102 includes support arms 602 on each side of the extension arms 304. The support arms 602 may have tubes (e.g., support sleeves 604) to couple the support arms 602 to the extension arms 304 in a manner that allows the extension arms 304 to extend and pivot. The support arms 602 may have support locking apertures aligned with the side locking apertures 318. The shaft of the interlocking pins 314 may interlock the extension arms 304 and support arms 602 in a low position or a high position through the locking apertures 318 on the sides 204. In the alternative, the interlocking pins 314 may interlock the support arms 602 with the extension arm 304 directly, or the interlocking pins 314 may simply run from the side 204 to the extension arm 304 bypassing the support arms 602.

When the self-contained lifting system 102 is shipped to a new workspace 104 it may be beneficial to restrict the movement of the lifting device 118 within the interior volume of the system 102. While the lifting device 118 may include brakes, as discussed with FIG. 4, a harness 606 may also be used to further secure the lifting device 118 during shipping and/or transportation. The harness 606 may be coupled to one of the lateral sides 204, the first side 300 of the deployable top 202, or another location on the self-contained lifting system 102 that may support the harness 606. When the system 102 arrives at the new workspace 104, the harness 606 releases the lifting device 118, and the interlocking pins 314 are removed from the sides 204. As the deployable top 202 is lifted, the extension arms 304 may be guided by the support arms 602 through the support sleeves 604. Other ways of guiding the extension arms 304 may be used, such as coupling the extension arms 304 to rollers riding on tracks 402. If support arms 602 and support sleeves 604 are used, the deployable top 202 is guided until the extension arms 304 and support sleeves 604 reach the second or third position.

Figure 7:
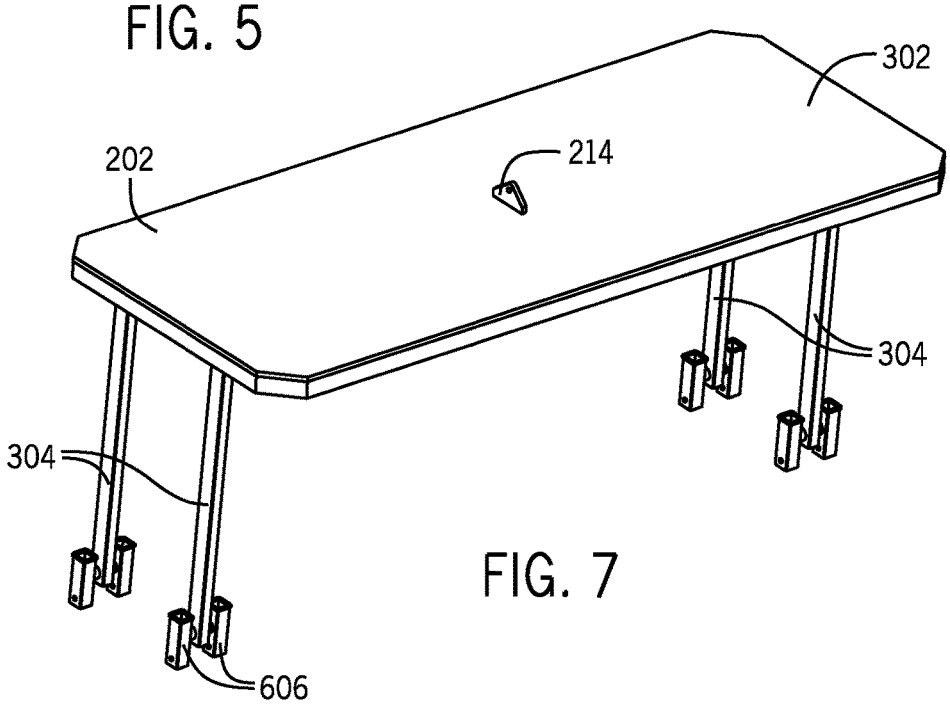
FIG. 7 is a perspective view of the deployable top with extension arms, in accordance with an embodiment of the present disclosure.

When the deployable top 202 is in the second or third position, the interlocking pins 314 may be inserted into the high locking apertures 318. For example, FIG. 7 shows a perspective view of the deployable top 202 that has been deployed with the sides 204 and base 200 hidden. As shown, the illustrated embodiment includes the extension arms 304 coupled to support sleeves 606. On the second side 302 (e.g., top side) of the deployable top 202, the crane attachment point 214 is also shown. At an approximately 20-40 degree pivot as described above, the extension arms 304 may deploy the top 3-8 feet above the top of the lateral sides.

Figure 8:
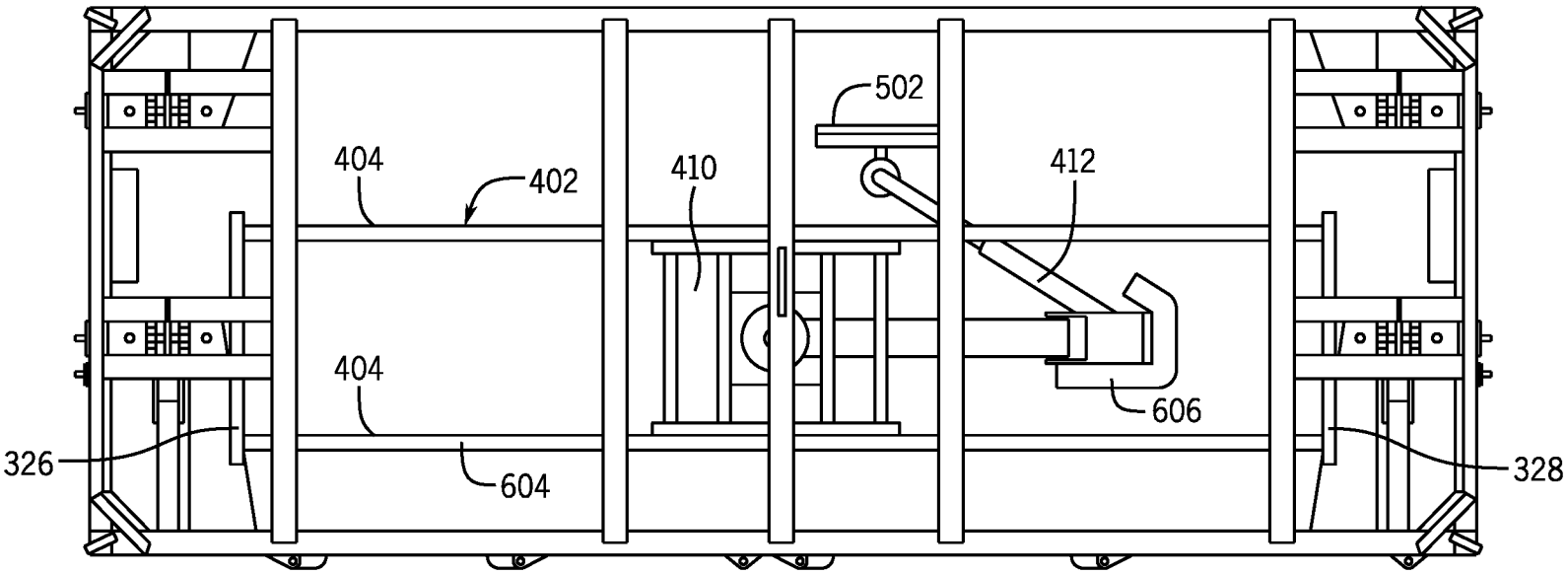
FIG. 8 is a cross-sectional top view of the self-contained lifting system, in accordance with an embodiment of the present disclosure.

FIG. 8 is a cross-sectional top view of the self-contained lifting system 102. The illustrated embodiment shows the interior volume of the lifting system 102 when the lifting system 102 is in the closed position. Specifically, the deployable top 202 (not shown) is in the closed position, and the lifting device 118 is folded and retained within the interior volume of the lifting system 102. As shown in FIG. 8, the system 102 includes the harness 606 for restricting movement of the lifting device 118 when the lifting system 102 is ready to be transported.

As described in detail above, present embodiments include the self-contained lifting system 102 which includes the enclosable lifting device 118, the deployable top 202 configured to support the lifting device 118 on the first side 300 of the deployable top 202, the plurality of lateral sides 204, the base 200 coupled to the plurality of lateral sides 204, and a plurality of extension arms 304 configured to extend and support the deployable top 202 when the deployable top 202 is deployed. The deployable top 202 enables overhead lifting of objects in a workspace 104, while also providing a self-contained lifting system that may be readily transported and used in a variety of workspaces 104. For example, the overhead lifting described above may provide for a non-obtrusive way to lift objects, such as core samples, on an oil rig.

This written description uses examples to disclose the present embodiments, including the best mode, and also to enable any person skilled in the art to practice the present embodiments, including making and using any devices or systems and performing any incorporated methods. The patentable scope of the present embodiments is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A method, comprising:

cutting a core positioned on a core stand of an oil drilling rig or platform workspace into a plurality of core sections;

positioning a lifting system on the oil drilling rig or platform workspace adjacent to the core stand, wherein the lifting system comprises a base, a pedestal extending from the base, and a lifting device coupled to the pedestal;

deploying the lifting device of the lifting system, wherein the lifting device comprises an arm extending from the pedestal and a plurality of grappling hands coupled to the arm;

positioning the lifting device over the oil drilling rig or platform workspace;

gripping a core section of the plurality of core sections with the plurality of grappling hands;

lifting the core section of the plurality of core sections with the lifting device; and moving the core section of the plurality of core sections from the core stand to a different location on the oil drilling rig or platform workspace.

2. The method of claim 1, wherein lifting the core section of the plurality of core sections with the lifting device comprises pneumatically actuating the grappling hands of the lifting device.

3. The method of claim 1, comprising setting a left movement limit and a right movement limit of the lifting device with a control panel of the lifting device.

4. The method of claim 1, wherein positioning the lifting device over the oil drilling rig or platform workspace comprises pivoting the arm of the lifting device about the pedestal.

5. The method of claim 1, wherein the arm is configured to rotate with respect to the pedestal to position the plurality of grappling hands.

6. The method of claim 1, wherein moving the core section of the plurality of core sections from the core stand to the different location on the oil drilling rig or platform workspace comprises moving the core section of the plurality of core sections from the core stand into a core safe.

7. The method of claim 1, wherein the core is positioned horizontally on the core stand.

8. The method of claim 1, comprising:

gripping an additional core section of the plurality of core sections with the plurality of grappling hands;

lifting the additional core section of the plurality of core sections with the lifting device; and moving the additional core section of the plurality of core sections to the different location on the oil drilling rig or platform workspace.

9. A method, comprising:

cutting a core positioned on a core stand of an oil drilling rig workspace into a plurality of core sections;

positioning a lifting system onto the oil drilling rig workspace adjacent to the core stand, wherein the lifting system is configured to support a lifting device of the lifting system, and wherein the lifting device comprises an arm and a plurality of grappling hands coupled to the arm;

gripping a core section of the plurality of core sections with the plurality of grappling hands; and lifting the core section of the plurality of core sections with the lifting device.

10. The method of claim 9, comprising:

lifting the lifting system onto the oil drilling rig or platform workspace with at least one aperture disposed on a deployable top of the lifting system, wherein the lifting device is supported by the deployable top;

locking extension arms of the deployable top in an extended position to raise the deployable top from a plurality of lateral sides of the lifting system;

laterally pivoting the extension arms to move the deployable top in a lateral direction; and moving the lifting device through an opening of the lifting system into an environment surrounding the plurality of lateral sides of the lifting system.

11. The method of claim 10, comprising translating the lifting device along a track disposed on an under side of the deployable top.

12. The method of claim 9, comprising positioning a pedestal of the lifting system on the oil drilling rig workspace.

13. The method of claim 9, comprising deploying the lifting device of the lifting system, wherein the lifting device is supported by a pedestal extending from a base of the lifting system.

14. The method of claim 9, comprising lifting the lifting system with a crane or forklift to position the lifting system on the oil drilling rig workspace.

15. The method of claim 9, wherein the lifting system comprises a base, a pedestal extending from the base, wherein the arm is coupled to the pedestal.

16. The method of claim 9, comprising gripping the core section of the plurality of core sections with the plurality of grappling hands of the lifting device after cutting the core into the plurality of core sections.

17. The method of claim 9, comprising:

gripping the core section of the plurality of core sections disposed on the core stand with the plurality of grappling hands on the oil drilling rig workspace; and pivoting the arm to move the core section of the plurality of core sections from the core stand to a different location on the oil drilling rig workspace, wherein the different location on the oil drilling rig workspace is within a core safe.

* * * * *